US012702200B2

(12) United States Patent
Seki

(10) Patent No.: US 12,702,200 B2
(45) Date of Patent: Aug. 11, 2026

(54) LACE SHOES AND TIGHTENING METHOD FOR LACE SHOES

(71) Applicant: VITAL-FUSS-KOCHI CO., LTD., Kochi (JP)

(72) Inventor: Koji Seki, Kochi (JP)

(73) Assignee: VITAL-FUSS-KOCHI CO., LTD., Kochi (JP)

( * ) Notice: Subject to any disclaimer, the term of this patent is extended or adjusted under 35 U.S.C. 154(b) by 0 days.

(21) Appl. No.: 18/574,279

(22) PCT Filed: Aug. 22, 2022

(86) PCT No.: PCT/JP2022/030273
§ 371 (c)(1),
(2) Date: Dec. 26, 2023

(87) PCT Pub. No.: WO2023/089879
PCT Pub. Date: May 25, 2023

(65) Prior Publication Data

US 2024/0285032 A1 Aug. 29, 2024

(30) Foreign Application Priority Data

Nov. 18, 2021 (JP) ..... 2021-187522

(51) Int. Cl.
*A43C 1/00* (2006.01)

(52) U.S. Cl.
CPC ..... *A43C 1/00* (2013.01)

(58) Field of Classification Search
None
See application file for complete search history.

(56) References Cited

U.S. PATENT DOCUMENTS 4,458,373 A * 7/1984 Maslow ..... F16G 11/101 36/138
4,999,889 A * 3/1991 LeCouturer ..... A43C 1/06 24/713.2

(Continued)

FOREIGN PATENT DOCUMENTS

CN 210248638 U 4/2020
JP H02130209 U 10/1990

(Continued)

OTHER PUBLICATIONS

International Search Report for International Application No. PCT/JP2022/030273, mailed Sep. 13, 2022 (7 pages).

(Continued)

*Primary Examiner* — Jila M Mohandesi
(74) *Attorney, Agent, or Firm* — ALSTON & BIRD LLP

(57) ABSTRACT

To eliminate the inconvenience of putting on and taking off lace shoes, to disperse the pressure sensation applied to the instep of the foot due to tightening at the time of putting on, and to ensure near-equal tightness of the shoelace tension after putting on with relative ease.
A lace shoe is provided with blade parts inside and outside, one blade part having one more shoelace-throughs arranged than the other, a single shoelace alternating between shoelace-throughs arranged in both blade parts and passing through all shoelace-throughs with the shortest path length. A binding tool tying both ends of the shoelace in the same direction is locked to a binding-tool stop fixed to the upper part of the lace shoe.

6 Claims, 9 Drawing Sheets

(56) References Cited

U.S. PATENT DOCUMENTS

| | | | | |
|---|---|---|---|---|
| 5,181,331 | A * | 1/1993 | Berger | A43C 11/00 24/712.1 |
| 5,537,763 | A * | 7/1996 | Donnadieu | A43C 7/00 36/50.1 |
| 6,502,329 | B1 * | 1/2003 | Silagy | A43C 1/06 24/713.4 |
| 6,560,898 | B2 * | 5/2003 | Borsoi | A43C 1/00 36/50.1 |
| 6,941,683 | B2 * | 9/2005 | Freed | A43C 1/003 24/712 |
| 9,700,101 | B2 * | 7/2017 | Lovett | A43C 11/165 |
| 9,730,492 | B2 * | 8/2017 | Krengel | A43C 3/00 |
| D846,850 | S * | 4/2019 | Sinclair | D2/935 |
| 10,791,798 | B2 * | 10/2020 | Lovett | A43C 11/20 |
| 2002/0050076 | A1 * | 5/2002 | Borsoi | A43B 5/0405 36/88 |
| 2003/0051374 | A1 * | 3/2003 | Freed | A43C 11/008 36/50.1 |
| 2004/0078999 | A1 * | 4/2004 | Freed | A43C 11/008 36/50.1 |
| 2005/0081403 | A1 * | 4/2005 | Mathieu | A43C 1/00 36/50.1 |
| 2008/0216351 | A1 | 9/2008 | Carroll et al. | |
| 2009/0090029 | A1 * | 4/2009 | Kishino | A43C 1/00 36/50.1 |
| 2009/0100707 | A1 | 4/2009 | Bar et al. | |
| 2013/0219747 | A1 | 8/2013 | Lederer | |
| 2017/0055642 | A1 * | 3/2017 | Krengel | A43C 11/008 |
| 2018/0027927 | A1 * | 2/2018 | Fisher | A43C 5/00 |
| 2019/0343231 | A1 | 11/2019 | Auyang | |

FOREIGN PATENT DOCUMENTS

| | | | |
|---|---|---|---|
| JP | H08503147 | A | 4/1996 |
| JP | H08503148 | A | 4/1996 |
| JP | H10179210 | A | 7/1998 |
| JP | 2010-516310 | A | 5/2010 |
| JP | 2012-525881 | A | 10/2012 |
| JP | 2015-000293 | A | 1/2015 |

OTHER PUBLICATIONS

Written Opinion of the International Searching Authority for International Application No. PCT/JP2022/030273, mailed Sep. 13, 2022 (7 pages).

European Application No. 22895167.9, Office Action mailed May 13, 2025.

* cited by examiner

[Fig. 1]
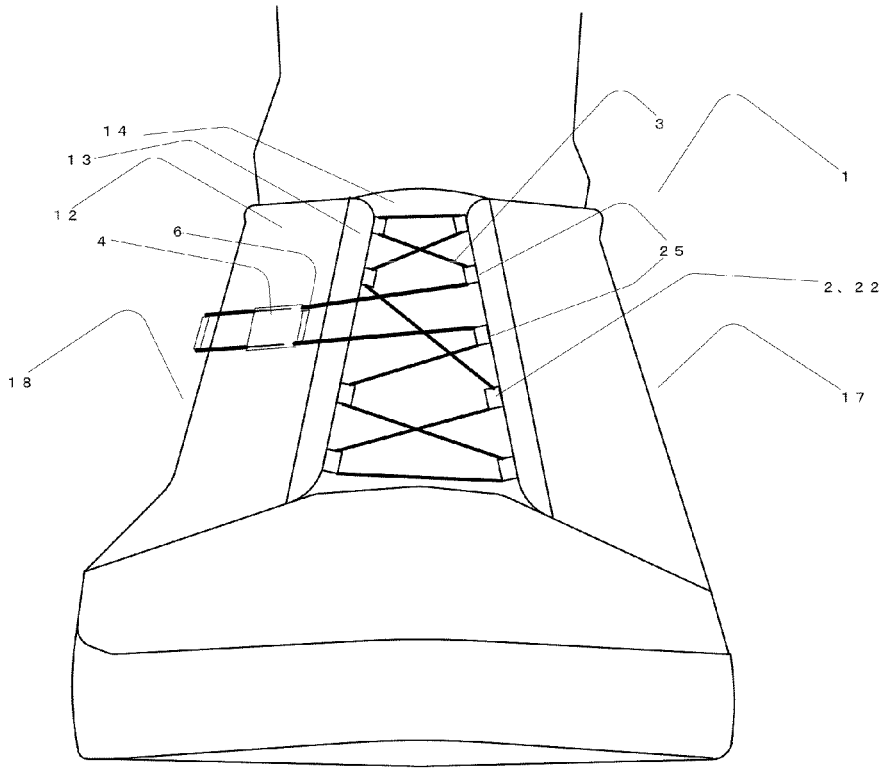

[Fig. 2]
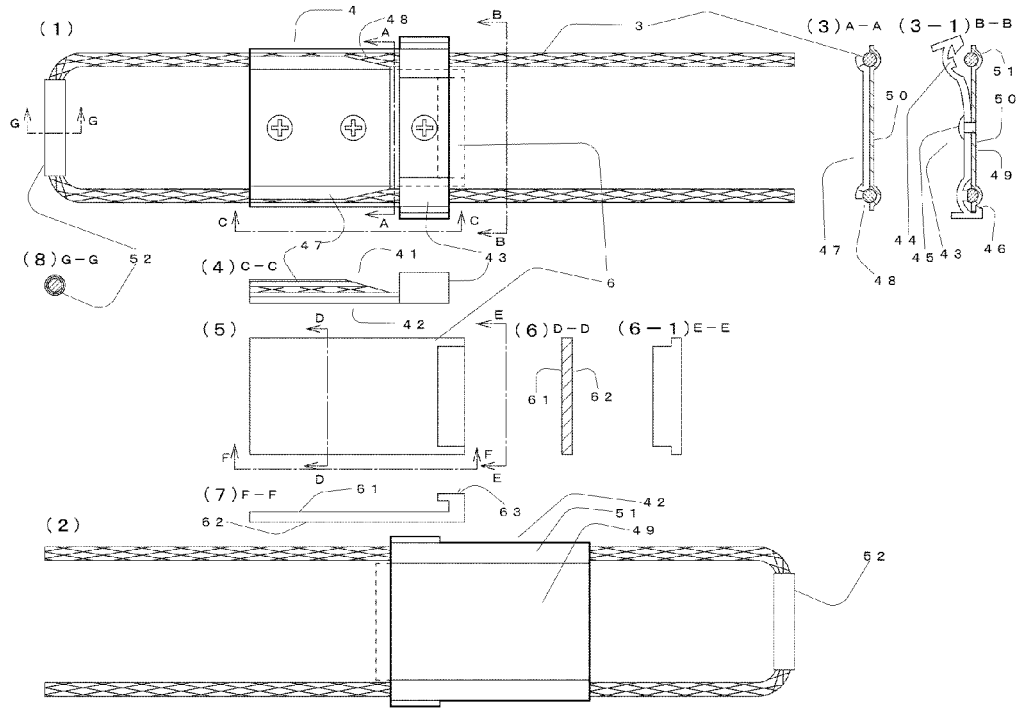
[Fig. 3]
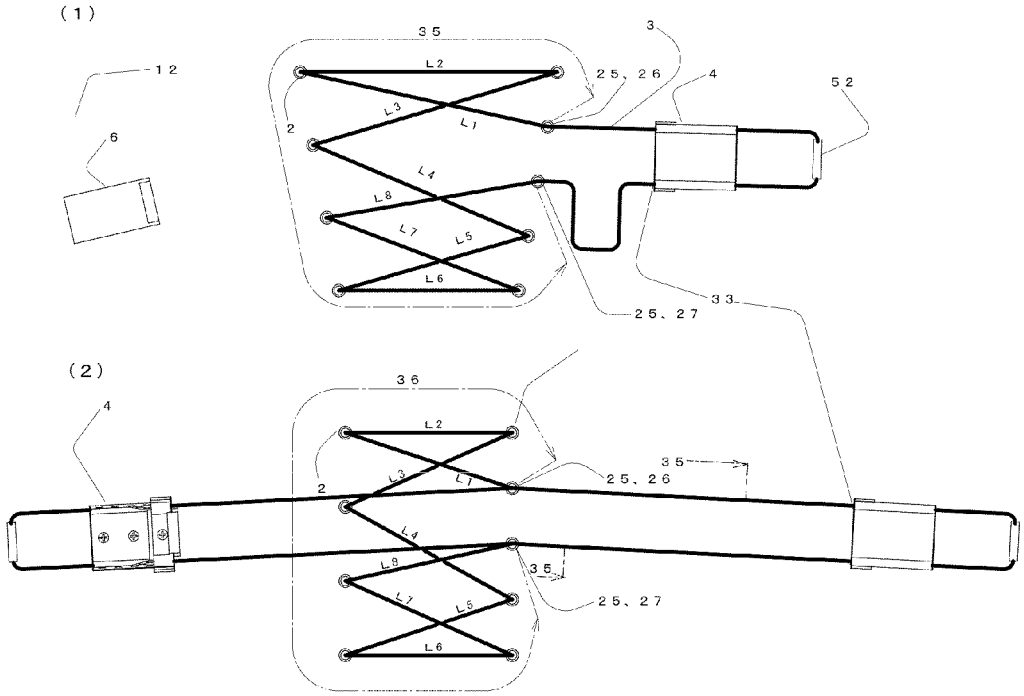

[Fig. 4]
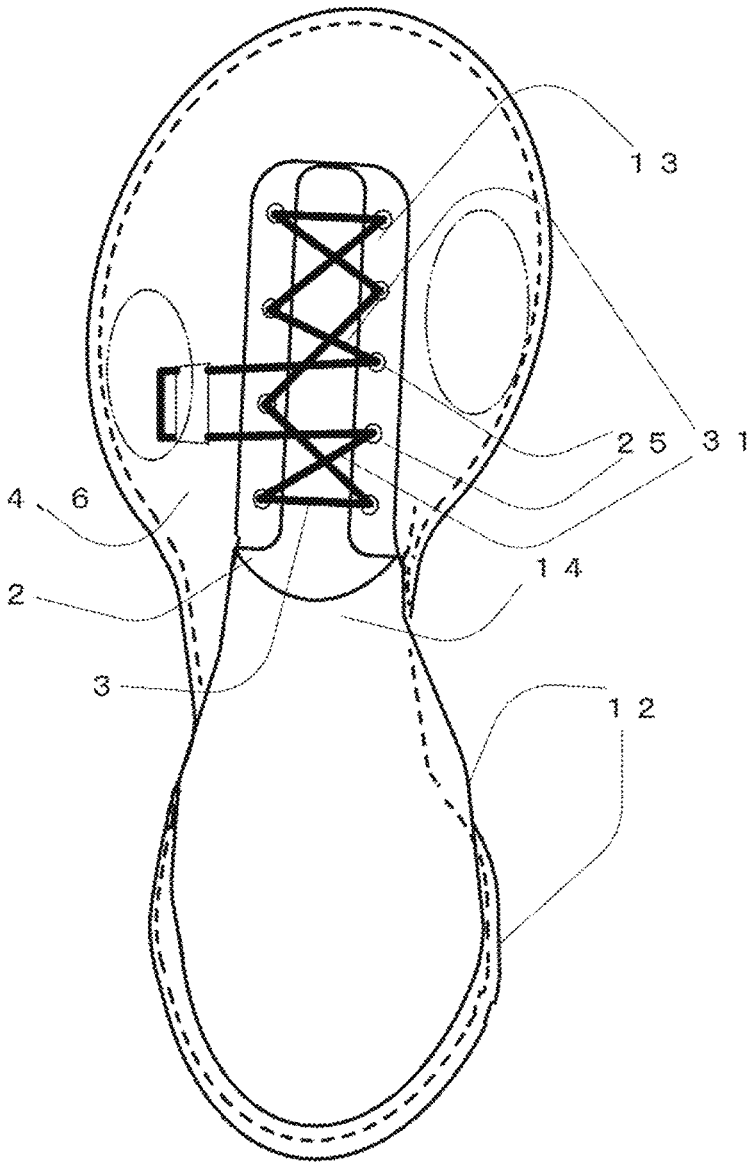

[Fig. 5]
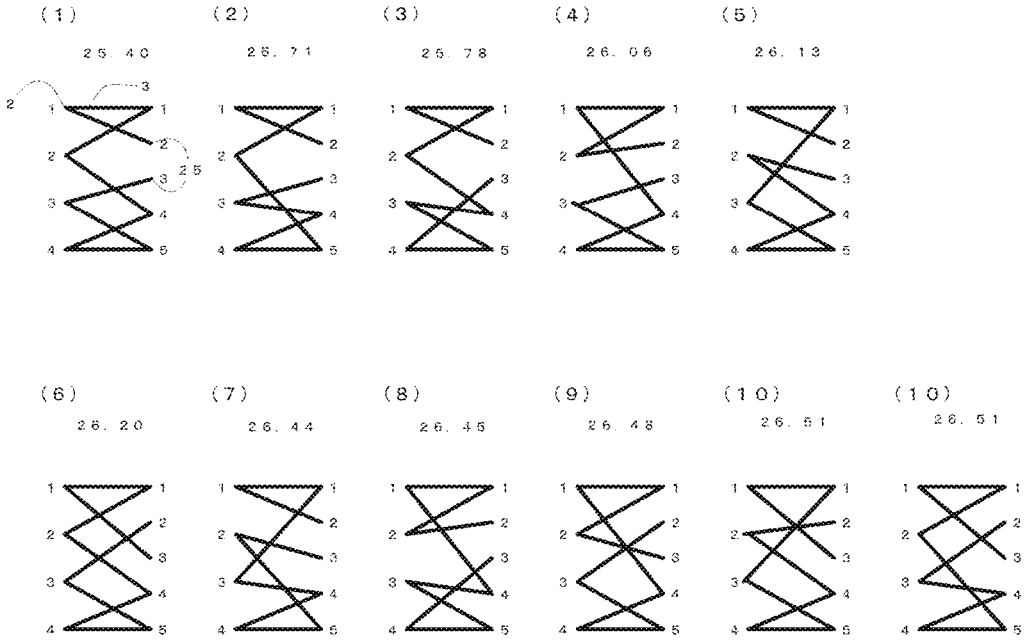
[Fig. 6]
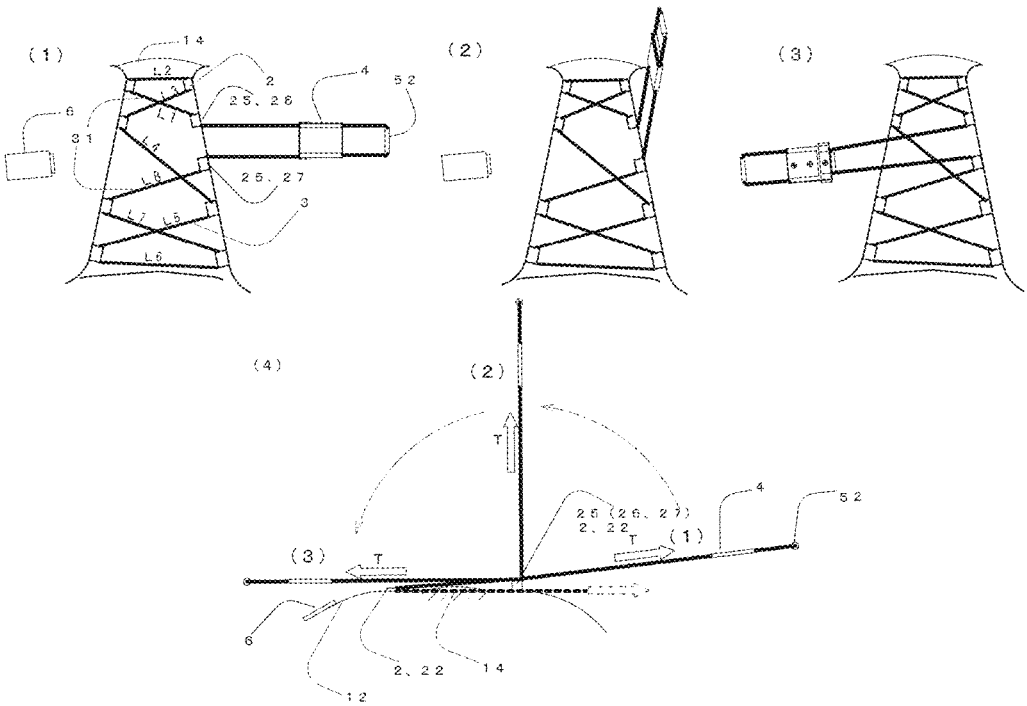

[Fig. 7]
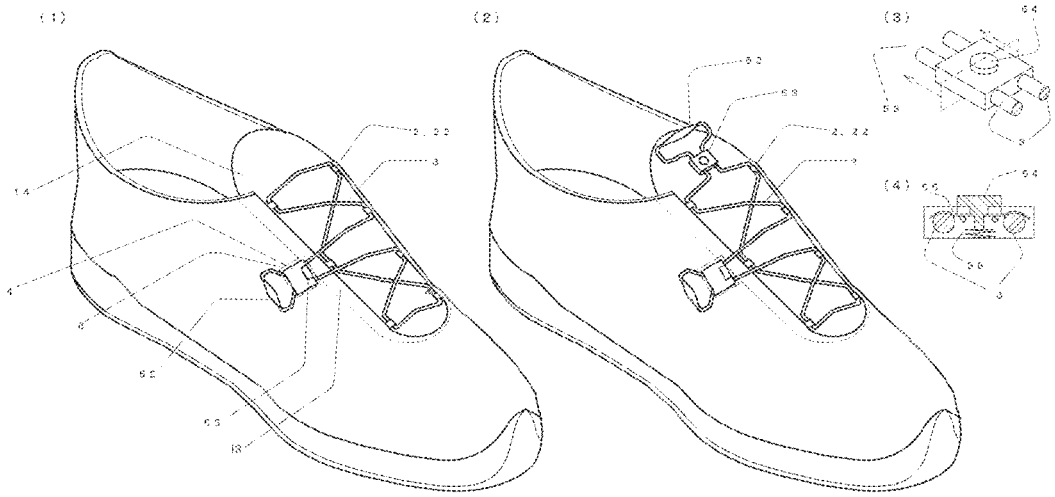
[Fig. 8]
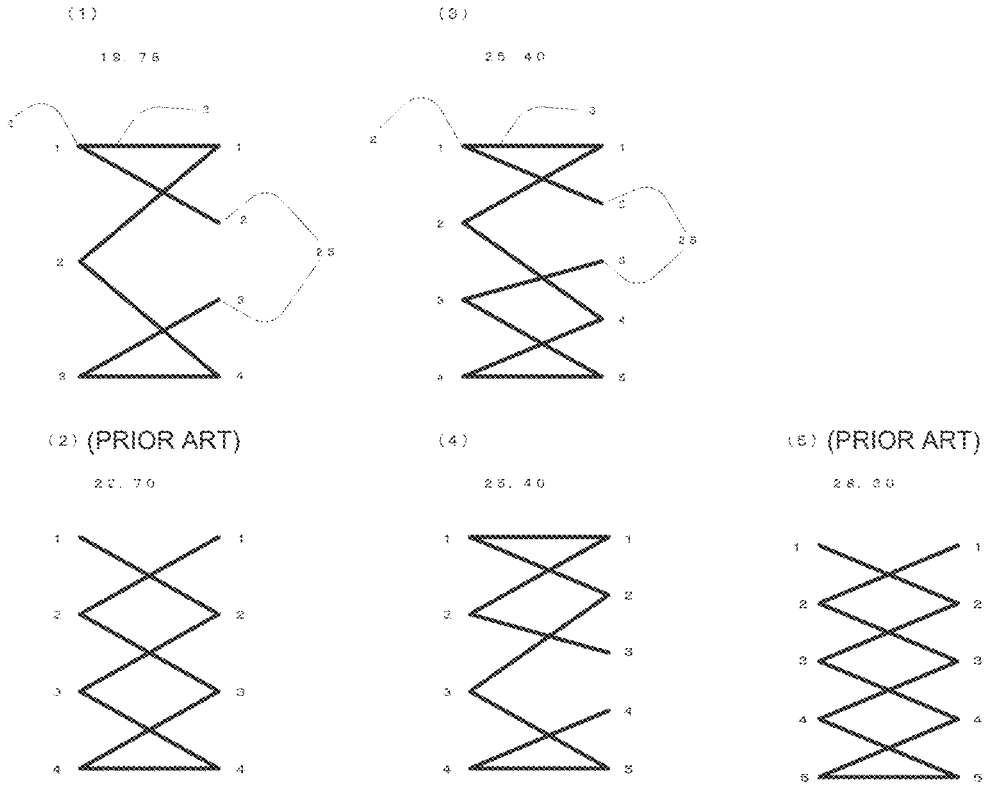

[Fig. 9]
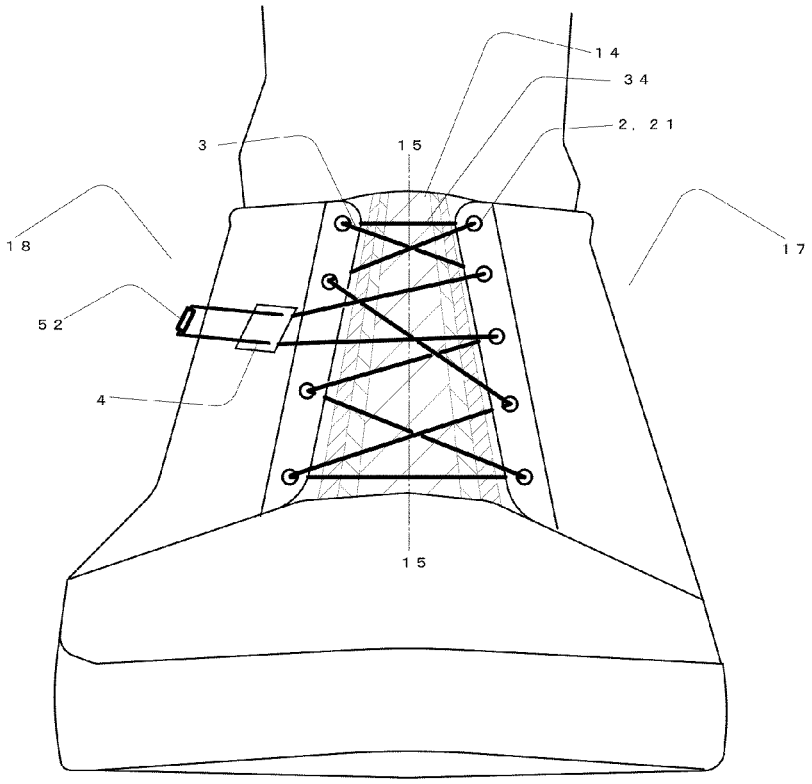

[Fig. 10]
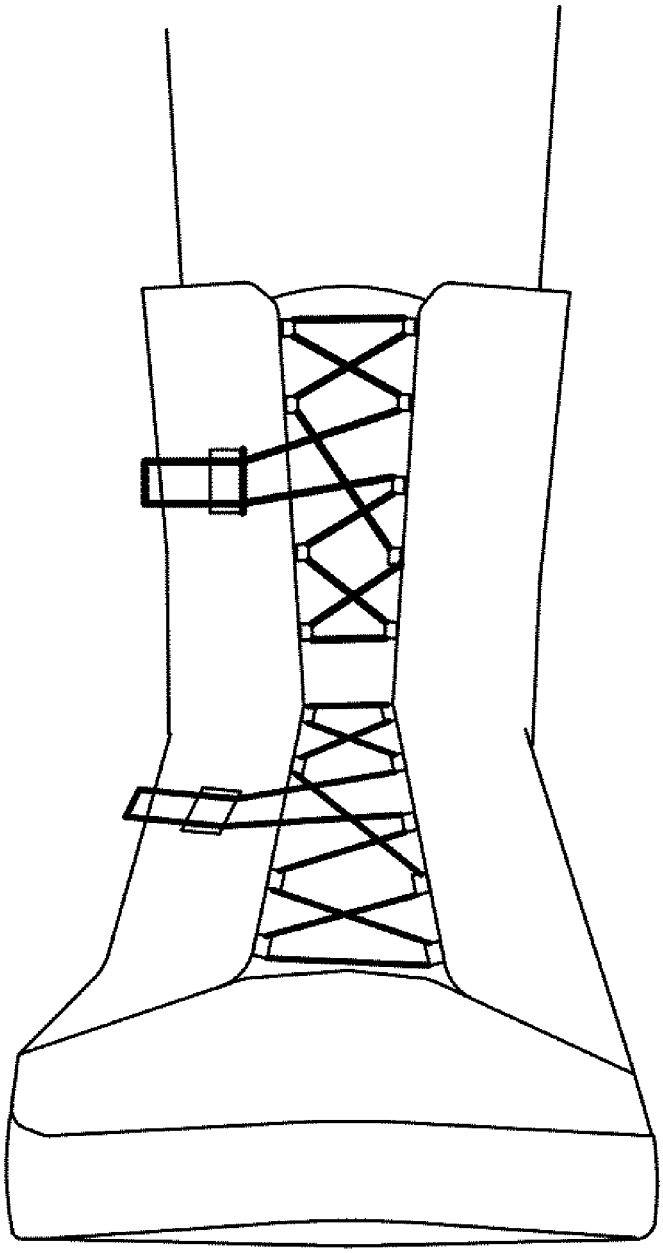

[Fig. 11] [Prior Art]
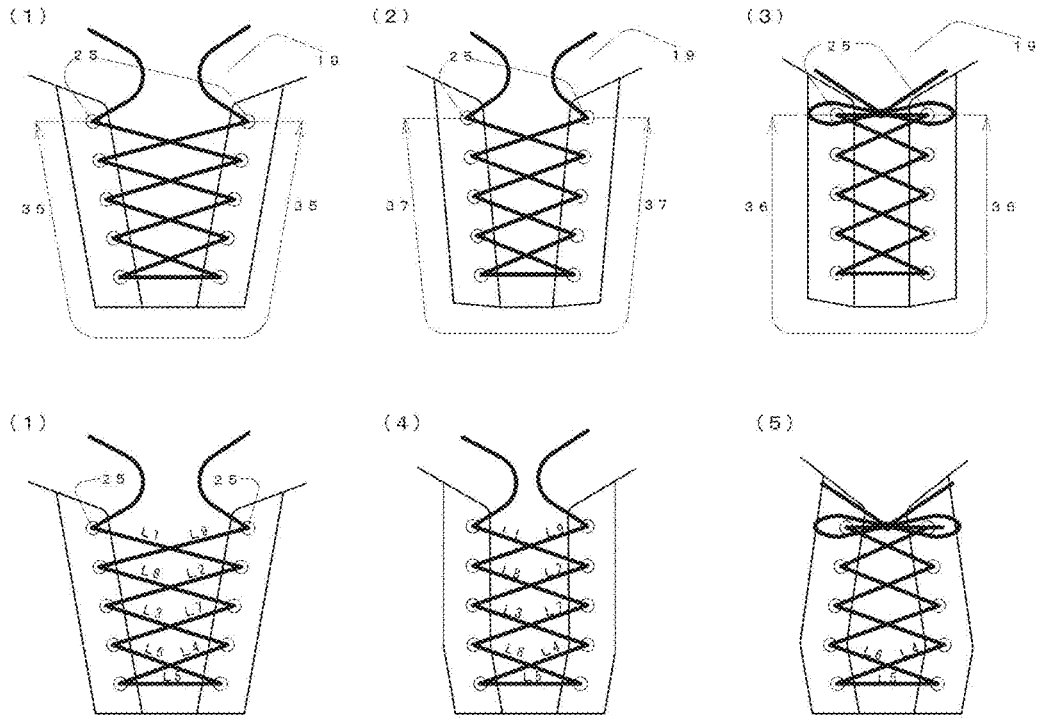
[Fig. 12] [Prior Art]
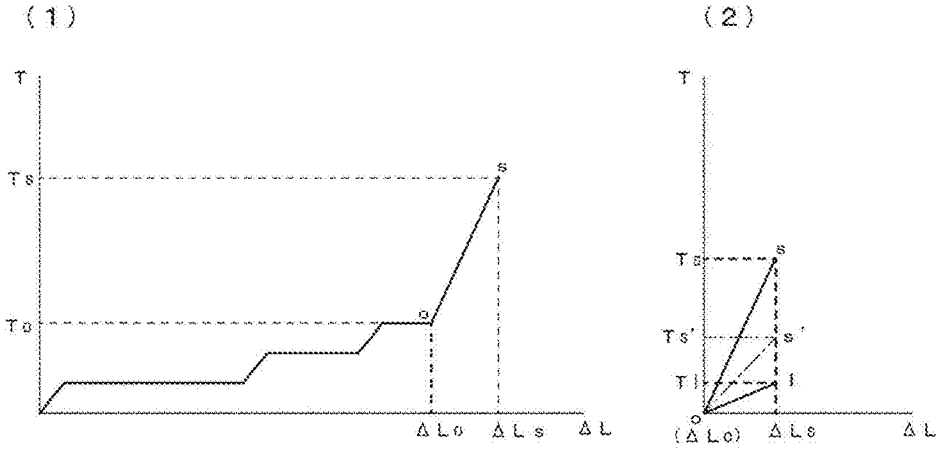

[Fig. 13] [Prior Art]
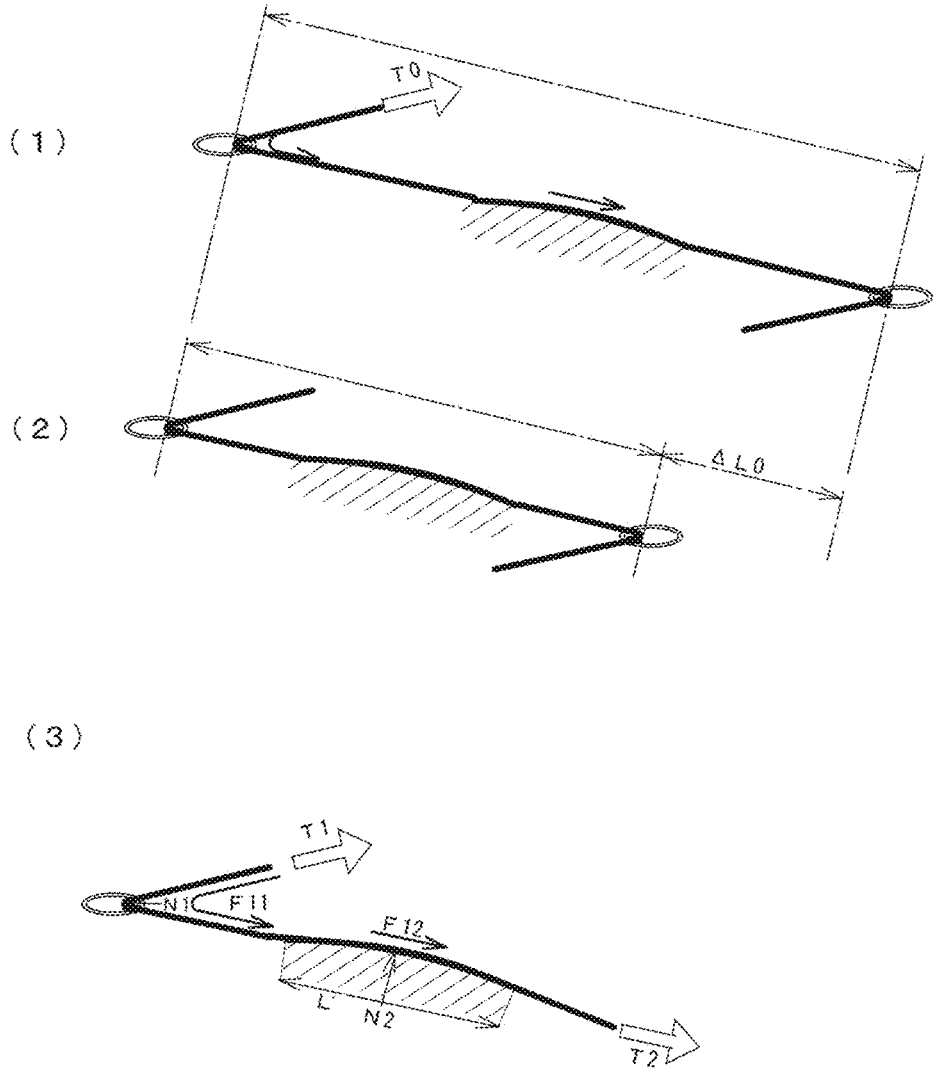

LACE SHOES AND TIGHTENING METHOD FOR LACE SHOES

CROSS REFERENCE TO RELATED APPLICATIONS

This application is a National Stage Application, filed under 35 U.S.C. § 371, of International Application No. PCT/JP2022/030273, filed Aug. 8, 2022, which international application claims priority to and the benefit of Japanese Application No. 2021-187522, filed Nov. 18, 2021; the contents of both of which are hereby incorporated by reference in their entirety.

BACKGROUND

Technical Field

The present invention relates to a tightening structure for lace shoes and a tightening method for lace shoes.

Description of Related Art

Lace shoes generally protect the bottom and instep of the foot and use laces for attachment and tightening. This type of shoe is tightened by passing one shoelace through a plurality of pairs of eyelets arranged in the direction from the toe side to the ankle side. In addition, A tongue part is provided between the shoelace tightening portion and the instep to protect the instep and prevent mud from entering the shoe.

How to tie the shoelaces is shown in FIGS. 11(1) to 11(3). Tighten the laces through the inner and outer eyelets closest to the toes. Then, tighten through the inner and outer eyelets of the next stage of the direction of the ankle. By repeating such work and tying the inner and outer shoelaces through the eyelet located closest to the ankle, the tightening is completed. After tensioning through the inner and outer eyelets, when moving to the eyelet of the next stage, the shoelace is inserted into the eyelet in a direction different from the tensioning direction of the shoelace, so the shoelace must be loosened once. Then tighten the laces again. That is, in repeated work of tension and relaxation, a feeling of fit of the foot that is familiar with the shoes is created.

It is a great advantage of lace shoes that they can be tightened according to individual differences in the shape of the foot and can be tightened according to changes in the shape of the foot due to exercise after wearing.

The lace shoes are tightened according to the circumference of each part of each person's foot, so there is no need to worry about them coming off easily, providing a sense of security and fatigue-free comfort. Such a sense of security and comfort cannot be obtained with shoes that do not tighten by the lace. In addition, it is possible to obtain a fit feeling by tightening with the same tensile force on the inside and outside of the upper surface of the instep part. Such a feeling of fit cannot be obtained by tightening with biased tensile force in the same direction as hook-and-loop fasteners.

It is the reaction force from the sole of the foot that supports a person's weight and is the starting point of movement. The impact load that occurs during exercise is handled by the inner and outer arches, one end of which is the heel of the foot, and the transverse arch formed in the forefoot, the other end of the two arches. Three arches work. In particular, when a large load is generated by exercise such as "running, jumping, and stomping", the shape change of the transverse arch and surrounding muscles in the forefoot reduces the burden on the foot due to the load. Appropriate tightening of lace shoes can provide sufficient comfort and fit against changes in circumference. This is because the elasticity of the long shoe laces and the entire shoe make it possible to obtain a feeling of conformity to the foot.

However, lace shoes have several drawbacks. It is not easy to tighten the shoelaces when wearing the shoes or to release the ties when taking off them. In particular, when the shoelaces are tied with appropriate tightening from the toe side to the tightening end point, it is necessary to loosen the shoelace to the toe side. Similarly, when re-wearing shoes that have been taken off once, the tightening operation must be performed again from the toe side while the shoelaces are inserted into many eyelets, which is extremely troublesome. Therefore, in order to secure the ease of putting on and taking off shoes at the expense of a certain degree of fit, we ensure that the shoelaces are tightened to the extent that they can be taken off while maintaining the bound state of the shoelaces. And when putting on, a method of using a shoehorn may be used.

In addition, when tightening with shoelaces, the wearing feeling obtained when standing still immediately after tightening differs from the wearing feeling during exercise such as walking or running. This is because when the shoelace is tied, a greater tensile force acts as the shoelace is closer to the tied portion, and the feeling of pressure on the instep of the foot varies depending on the location. Even if the shoe is tightened with an appropriate fit when worn, if a large amount of force is applied to the inside of the shoe due to exercise, the force applied to the sole part will change, such as widening the foot width. As a result, the tensile force of the entire shoelace will be evenly distributed, and the lace shoe as a whole becomes loose with a large amount of play. Conversely, if an attempt is made to ensure the appropriate tightening state that is finally obtained, the feeling of oppression that occurs on the instep due to the tightening at the time of wearing will be extremely large. It is possible, but not easy, to tighten the shoe so as to obtain a comfortable fit to the foot.

Various inventions have been proposed to compensate for the mentioned drawbacks of lace shoes. One part of the buckle is fixed to one side of the shoe upper, a plurality of shoelace insertion holes is provided on the other part of the buckle, and the shoe upper can be tightened and loosened by attaching and detaching the buckle without tightening and loosening the shoelace (JP H02-130209U (1990)). Although this invention can eliminate the inconvenience of putting on and taking off shoes with laces, the tension from the shoelace generated in the shoelace insertion hole provided at the other part of the buckle is concentrated at the fixed part of the buckle. Since the tensile force is not exerted over a wide area of the shoe upper, it is not possible to obtain a feeling of fit as when wearing ordinary lace shoes.

There are the following proposals for tongues of lace shoes. By providing a pad on the bottom side of the tongue, a cavity is formed, and depending on the mode, by passing the shoelace through the cavity, coupled with the holding mechanism, it becomes easy to tighten the middle part at the place where tightening is required (JP 2012-525881A). However, in this invention, the tightening direction of the shoelace does not match the tightening direction of the lace shoe upper, so the tightening of the lace shoe is not successful.

The following proposal have been made to enable tightening of a plurality of shoelaces by one action. In that proposal, a lace shoe comprise shoelaces, a suitable number of shoelace-throughs attached to each of the inner and outer uppers, a lace binding tool which is a member for bundling and fixing both ends of the shoelaces, a tightening adjustment band connected to the lace binding tool, and a binding device that engages with the tightening adjustment band and can be locked and released freely (JP H 10-179210A (1998)). It is necessary to use a plurality of shoelaces in order to obtain a tight fitting feeling by applying uniform pressure from the instep to the bottom of the foot, which is an advantage of shoelaces. However, in this proposal, since a plurality of shoelace must be tied at one point, there is a difficulty in adjusting the binding at the shoe binding section.

There is an invention of a fixed shoelace winding device that includes a reel for winding a shoelace, a dial for rotating the reel, and a mechanism that can be released freely (JP 2015-000293A). It is extremely easy to bind by rotating the dial and release by unlocking, but the shoelaces must be stored in the winding device, and the shoelaces are limited to thin and strong materials such as wire, and it cannot be applied to lace shoes that have soft and thin upper material. In addition, the shoelace winding device fixed to the upper limits the direction of the tensile force applied to both ends of the shoelace and limits the magnitude of the tensile force due to tightening by rotating the dial.

There is an invention of a lace shoe comprising a lace member alternately having inner and outer paths, direction changing members (eyelets) for changing the direction of the lace member arranged in an odd number on the inner side and the outer side, and a tensile mean provided in the bending folds (top part of the instep). The tensile mean is used to tighten the two free ends of the lace member (JP H08-503148A). Although it was possible to easily tighten the laced shoe with a single action performed at the same time, efficient tightening was not possible due to the fact that the pulling direction was limited and the tensile force was lost due to friction between the lace member and the tightening area such as the tongue.

There is an invention of a lace shoe comprising an anchor fixed on the first side (outside of the lace shoe) and a fastener simultaneously pulling both ends of the lace on the second side, with at least one lace and an odd number of lace holes on each side. The invention has been proposed (US 2009/0100707A1) that can obtain efficient shoelace pulling force in a single operation. However, there is no improvement in the route of the shoelace, the frictional resistance during tightening is large, and the position of the anchor is limited to the top of the instep, so the final tensile force during tightening is unevenly distributed on the top of the instep, which is uncomfortable, and there is no consideration for early equalization of the tensile force over the entire shoelace after tightening.

BRIEF SUMMARY

The problem to be solved is to eliminate the inconvenience of putting on and taking off lace shoes, disperse the feeling of pressure applied to the instep of the foot due to tightening at the time of wearing, and relatively easily tighten a shoelace with a nearly evenly tension obtained after wearing. To propose a tightening structure and a tightening method for a shoelace, which can quickly utilize the expansion and contraction of the entire lace shoe after tightening by tension acting on both ends when the shoelace is tightened.

A lace shoe that can be tightened according to the circumference of each part of a foot, regarding the right or left half foot of the lace shoe, the lace shoe comprising:

both blade parts of shoelace-stay installed on an inner and an outer side of an upper part of the lace shoe (in terms of the direction of the part of a shoe, a big toe side of the worn foot is called an inner side, and a little toe side is called an outer side, the same shall apply hereinafter);

a group of shoelace-throughs arranged on the both blade parts with one greater number of shoelace-throughs in one blade part than the other blade part, the shoelace-throughs forming a single row on each blade part;

a single shoelace that alternately tightens the inner side and the outer side, passes through all of the group of shoelace-throughs, and can be closed by tying both ends of the shoelace;

starting and ending shoelace-throughs that are starting and ending points of the single shoelace in the group of shoelace-throughs, the starting and ending shoelace-throughs being two adjacent points that are neither on both end stages (referring to alignment in the general transverse direction to the row), being placed on the one blade part, having the shortest path among all the paths of the single shoelace between the starting and ending points;

a binding tool with which is tied both ends of the single shoelace in the same direction, allowing the single shoelace to be pulled from the shoelace-throughs continuous to the starting and ending shoelace-throughs in directions of sections between two continuous shoelace-throughs (hereinafter referred to as starting and ending shoelace-throughs sections); and a binding-tool stop that is fixed to the upper part on the side of the other blade part where the starting and ending shoelace-throughs are not placed, locking the binding tool.

A group of shoelace-throughs is arranged so that a shoelace can be tightened efficiently and effectively, and starting and ending shoelace-throughs are arranged on one blade part of shoelace-stay, and starting and ending shoelace-throughs sections are separated so that the feeling of pressure on the instep caused by tightening of the shoelace is dispersed, and the lace shoe tightening is realized assuming changes in the circumference of the foot during exercise. By minimizing the path length of the shoelace, the tension load on both ends of the shoelace can be almost evenly distributed over the entire shoelace. In addition, it is not necessary to tie both ends of the shoelace, which is the final work of tightening the laced shoe, and the tightening work can be completed by an extremely easy work of locking a binding tool at a binding-tool stop.

BRIEF DESCRIPTION OF THE FIGURES

FIG. 1 is an explanatory diagram of tightening conditions of a lace shoe of shoelace-throughs in five stages of the inner side and four stages of the outer side. (Example 1)

FIG. 2 is an explanatory diagram of a binding tool and a binding-tool stop. (Example 1)

FIG. 3 is an explanatory view relating to the position of the binding-tool stop. (Example 1)

FIG. 4 is an explanatory diagram relating to the position of starting and ending shoelace-throughs. (Example 1)

FIG. 5 is an explanatory diagram relating to the path length of the shoelace. (Example 1)

FIG. 6 is an explanatory diagram of starting and ending shoelace-throughs sections. (Example 1)

FIG. 7 is an explanatory diagram of tightening conditions of the lace shoe with shoelace-throughs in four stages of the inner side and three stages of the outer side. (Example 2)

FIG. 8 is an explanatory diagram of various shoelace tightening paths according to the present invention. (Examples 1 and 2)

FIG. 9 is an explanatory view of a lace shoe in which eyelets are used for the shoelace-throughs and a pattern is attached to the tongue part as a mark of a uniform tension load on the inside and outside. (Example 3)

FIG. 10 is an explanatory diagram of a tightening condition of a lace boot using the present invention.

FIG. 11 is an explanatory diagram of a conventional method and procedure for tightening and tying of a shoelace.

FIG. 12 is an explanatory view relating to changes in the tension of the shoelace.

FIG. 13 is an explanatory view relating to the tension of the shoelace and the frictional force generated on the shoelace.

DETAILED DESCRIPTION OF VARIOUS EMBODIMENTS

The name of a part, a position and a direction in the lace shoe according to the present invention will be explained. A part other than the sole of the lace shoe are called an upper part. A big toe side of the foot is called an inner side, and a little toe side is called an outer side, and the same applies to shoes.

The part of the upper part that is tightened by the shoelace is called a blade part of shoelace-stay, and a plurality of shoelace-throughs arranged on the inner and outer blade parts form rows in the longitudinal direction from the ankle to the toe, and form stages in the transverse direction. The shoelace-throughs form an inner row and an outer row in each blade part. On the other hand, regarding the arrangement in the transverse direction substantially perpendicular to the rows, the stage of the instep near the ankle is an upper stage and the stage near the toe is a lower stage. The shoelace is alternately passed or hooked on the inner and outer shoelace-through. At that time, the section between two consecutive shoelace-through in which the shoelace directly exerts tension on each other is called a shoelace-through section. The tension of the shoelace is transmitted to the blade part, and its effect extends to the entire upper. Shoelaces-through is generally a shoelace-hole or an eyelet, and has various forms. In this specification, all of them are generically referred to as shoelace-through, including hook-shaped ones, belt-shaped ones, and string-shaped ones. A band or string-like thing is called a shoelace-band. The tongue part is provided above the instep and below the part tightened by the shoelace, including between the inner and outer blade part, and protects the instep by preventing contact of the shoelace with the instep and as a mudguard. One side of a pair of shoes is called a left half foot or a right half foot, and a single shoelace is used for tightening a group of shoelace-throughs. Tightening is usually completed by tying the ends of the shoelace. Regarding the shoelace-throughs that are inserted or the like, the two shoelace-throughs closest to both ends of the shoelace are called starting and ending shoelace-throughs, and the two sections with the starting and ending shoelace-throughs are called starting and ending shoelace-through-sections.

A method of tightening a conventional lace shoe will be explained with reference to FIG. 11.

A description will be given of a case in which the shoelace is passed through all shoelace-throughs and a shoe is put on, and after the open part is widened for taking off the shoe, the lace shoe is tightened to put the shoe on. Assuming that FIG. 11(1) shows the state in which the open part 19 is widened, the length of the shoelace that is necessary and sufficient between the starting and ending of shoelace throughs is called a required effective shoelace length 35. FIG. 11(2) shows a state in which the excess shoelace is pulled out from the starting and ending shoelace-throughs 25 in order to close the open part that was widened when the shoes were taken off. This length of the shoelace is called the wearing shoelace length 37. FIG. 11(3) shows a state in which the shoelace is further pulled out and tension is applied until the foot tightly fits inside the shoe (hereinafter, the pulling force and tensile force, which are forces in the direction of tightening the shoelace, will also be referred to as tension). The length of the shoelace required for this condition is called the tightening shoelace length 36.

FIG. 12(1) schematically shows the relationship between the tension applied from the starting and ending shoelace-throughs and the pull-out length from the starting and ending shoelace-throughs in the state shown in FIG. 11(1). The vertical axis T is the tension acting on the shoelace. The horizontal axis ΔL is the pull-out length from the starting and ending shoelace-throughs. When point o is reached in FIG. 12(1) by tensile strength $T_o$ and pullout length $\Delta L_o$, the state is shown in FIG. 11(4), and then point s is reached by tensile strength $T_s$ and pullout length $\Delta L_s$, at which stage the tightening is completed by binding both ends and the state is shown in FIG. 11(5). The change from the state of FIG. 11(1) to FIG. 11(2) and further to the state of FIG. 11(3) does not occur only with the action of tension from both ends of the shoelace. The state shifts from FIG. 11(1) to FIG. 11(4), and then to FIG. 11(5). From the state of FIG. 11(5), the force applied from the foot to the lace shoe by exercising or the like brings the tension of the entire shoelace into a nearly uniform state, resulting in FIG. 11(3). In FIG. 12(1), the tensile force changes stepwise until reaching the point o, and between the point o and the point s, the tension changes from $T_o$ to $T_s$, and the pull-out length changes linearly from $\Delta L_o$ to $\Delta L_s$.

Assuming that a first stage is from the start of pulling the shoelace (T=0, ΔL=0) to the point o in FIG. 12(1), in the first stage, after the open part is opened, a portion of shoelace, which is no longer needed when the shoe is worn, is pulled out from the shoelace-throughs. When the shoelace pulled out, the frictional force acting while the shoelace passes through the shoelace-through and the frictional force generated on the tongue part, etc. is applied as shown in FIG. 13(1). By applying a tension $T_o$ corresponding to these frictional forces, the state shown in FIG. 13(2) is obtained. The pull-out length (is $\Delta L_o$, however, in FIG. 13(2), $L_o$ is shown within one shoelace-through section for simplification) of the unnecessary shoelace pulled out by this tension is determined by factors such as the material and diameter of the shoelace in the shoelace-through section, the shape and the contact length on the shoelace-through section, the material at the contact portion, etc., and it is thought that there is little change due to the magnitude of the tension. As shown in FIG. 12(1), the stepwise change is due to the number of shoelace-throughs which the shoelace passes and the contact length of the shoelace-through sections. FIG. 12(1) shows that the shoelace is pulled out in the third shoelace-through section from the starting and ending shoelace-throughs. In the state obtained at point o, when the tension of the entire shoelace is evenly distributed, the foot is covered with the inside of the shoe without any feeling of pressure, and the tension of the shoelace becomes zero.

Next, from point o to point s in FIG. 12(1) is the second stage, in which the length of ($\Delta L_s - \Delta L_o$) is pulled out from the wearing shoelace length. During this period, the shoelaces are tightened to such an extent that a strong feeling of pressure is generated on the instep of the foot (state shown in FIG. 11(5)).

By equalizing the tension of the entire shoelace, the inside of the shoe and each part of the foot can be in a fitted state (state shown in FIG. 11(3)) to the extent that they do not loosen.

FIG. 12(2) shows the relationship between tension and pull-out length when tension is applied to the state of the wearing shoelace length in the tightening process of the shoelace in the second stage. A point s in FIG. 12(2) indicates a change from the wearing shoelace length of the point o as the origin. A point 1 indicates a state assumed after a load is repeatedly applied from the foot to the lace shoe by exercise or the like from the tightened state of s. That is, the tension is reduced from $T_s$ to $T_1$ with the same pull-out length. This is because the range of tension $T_s$ applied to both ends of the shoelace during tightening is limited to specific shoelace-through sections, in the state of tension $T_1$, it indicates a state in which the entire shoelace has nearly uniform tension. One of the purposes of the present invention is to ensure a state s' close to the final state 1 at the time of tightening, as indicated by the dashed line in FIG. 12(2). Therefore, in order to avoid the state of the solid line to the point s in FIG. 12(2), the following considerations are made. The loss due to the frictional force generated when transmitting the tension of the shoelace shown in FIG. 13(3) is according to the following formula.

$$T_1 = F_{11} + F_{12} + T_2 \qquad \text{[Math. 1]}$$

From $F_{11} \propto N_1 \propto T_1$ $F_{11}$: Friction force involved in passing through the shoelace−through $$F_{11} = a \times T_1$$

$a$: Constant of proportionality $$F_{12} \propto L' \times N_2 \propto L \times T_1$$

$F_{12}$: Frictional force on the shoelace−through section $$F_{12} = b \times L \times T_1$$

$b$: Constant of proportionality $L'$: Contact length of tongue part, etc.

$L$: Length of the shoelace−through section $N_2$: Normal force at the contact, proportional to $T_1$ $$T_1 = a \times T_1 + b \times L \times T_1 + T_2$$

$$T_2/T_1 = 1 - (a + bL)$$

$$\text{if } r = a + bL$$

$$Ti = (1 - r)^{i-1} \times T_1$$

According to Math. 1, the tensile force $T_1$ applied to both ends of the shoelace loses the force through the shoelace-through and due to contact with the tongue part, etc., and $T_2$ acts to the next shoelace-through section. The frictional force involved in passing through the shoelace-through in FIG. 13(3) is $F_{11}$ in Math 1, and $F_{11}$ is considered to be proportional to the normal force $N_1$ between the shoelace-through and the shoelace. Considering that $N_1$ is proportional to $T_1$, it is presumed that $F_{11}=a \times T_1$. On the other hand, the frictional force in the shoelace-through section is $F_{12}$ in Math 1, and is proportional to the product of the normal force $N_2$ applied by the shoelace to the tongue part in the shoelace-through section and the contact length L'. As a result, $F_{12}=b \times T_1 \times L$ is derived. Math 1 shows that the tensile force $T_1$ applied to the end of the shoelace by these two frictional forces is lost at a rate of (1−r) for each shoelace-through section. According to Math 1, when the lengths of the shoelace-through sections L are the same, a tensile force at a position is determined by the number of the sections. For example, if the tension becomes 0.6 by passing through one section, 1−r=0.6, and in the fourth section shown in FIG. 11, the tensile force is about 13% towards the tension applied to both ends of the shoelace. If the tensile force is equal to or less than the constant tension (the stepped tension in FIG. 12(1)), the tensile force applied with the shoelace will not be applied after the fourth section. In FIGS. 11(4) and 11(5), the fourth and subsequent sections from both ends of the shoelace are $L_4$, $L_5$, and $L_6$. The state from the bottom to the second stage are not tightened, shown in FIG. 11(5), same as FIG. 11(1), and the third and upper stages are tightened with the tightening shoelace length ($\Delta L_s - \Delta L_o$).

Example 1

The present invention relates to the case where the lace shoe is tightened from the state in which the shoelace 3 of the effective shoelace length is passed through all the shoelace-throughs 2 (the state in which the open part is open), applying tension to the entire shoelace by the action of tension from both ends of the shoelace without retying the shoelace from the lower stage. This makes it possible to obtain the state of point s', which is close to point 1 in FIG. 12(2), by very easy work.

FIG. 1 shows shoelace-throughs (shoelace bands 22) 2 with 5 stages of an inner side 17 and 4 stages of an outer side 18 on a both blade parts, and starting and ending shoelace-throughs 25 are arranged on the second and third stages from the top of the inner side. The both ends of the shoelace are tied in the same direction, and a binding tool 4 that secures a width close to the width between the starting and ending shoelace-throughs is locked to a binding-tool stop 6 fixed to the outer upper part 12. Regarding the route through which a single shoelace passes through the shoelace-throughs, the above consideration that the length of the extension that receives friction should be shortened suggests that it is possible by shortening the length of the route. The lace shoe shown in FIG. 1 shows how to tie the shortest path through which the shoelace passes, with the second and third stages from the top about the starting and ending shoelace-throughs.

FIG. 2 shows a detailed view of the binding tool 4 and the binding tool stop 6. As shown in FIGS. 2(1) to 2(4) are detailed views of the binding tool, FIG. 2(1) being a front view, and FIG. 2(2) being a rear view. The dashed line in FIG. 2(1) indicates the binding tool on the binding-tool stop in a state where the binding tool is locked by the binding-tool stop. The binding tool consists of an upper plate 41 and a lower plate 42. As shown in the front view of FIG. 2(1), the upper plate has a shoelace locking part 43 for binding both ends of the shoelace in the same direction and a shoelace direction guiding part 47 for guiding the direction of the shoelace. As shown in B-B figure of the right-side view in FIG. 2(3-1), it is possible that the shoelace locking part can lock the shoelace at a free position by means of a shoelace locking protrusion 44. The shoelace locking part has an elastic member, has an elastic deformation fixing part 45 at the center portion in the lateral direction, and at both ends has claws for locking 46 that can be engaged with the lower plate. FIG. 2(3-1) shows a state before hooking on one side and a state after hooking on the other side. A-A of FIG. 2(3) shows the structure of the shoelace direction guiding part that allows the shoelace to be easily inserted through a guiding part insertion port 48. As shown in FIG. 2(2), the lower plate of the binding tool has a flat plate part 49 and a lace passing part 51. The flat plate part is made of a magnet or a ferromagnetic material, and has a structure that can be detachably adhered to a surface in contact with binding tool 61 on the upper surface of the binding tool stop. As shown in FIGS. 2(1), (2) and (8), the shoelace behind the direction guiding part is provided with a cylindrical lace picking part 52 that rotatably covers the circumference of the shoelace. The lace picking part can apply the tensile force to the binding tool by manipulating of the both ends. Therefore, the magnitude and direction of the tension applied to both ends of the shoelace through the starting and ending shoelace-throughs can be changed depending on the lace picking part and the binding-tool stop. In the tied state of the present invention, the both ends of the shoelace are positioned at the binding tool, and the both ends of the shoelace shown in FIG. 2(1)-(4) are both ends of one shoelace. Therefore, the shoelace locking part can easily and freely change the binding position by using elasticity, and can adjust the length of the shoelace.

The binding tool stop 6 is fixed to the outer upper part 12, as shown in FIG. 1, and the details are as shown in FIGS. 2(5) to 2(7). FIG. 2(5) is a front view showing a surface in contact with binding tool 61 provided with a magnet, and FIG. 2(7) is a bottom view showing a surface in contact with upper part 62. The surface in contact with binding tool and the surface in contact with upper part are plate-shaped as shown in D-D of FIG. 2(6), and the area shown in FIG. 2(5) are almost identical with the lower plate of the binding tool. As shown in FIGS. 2(5) and 2(7), on the right side of the front, a no-slip part on binding-tool stop 63 is provided to prevent the binding tool slipping to the right side from the binding-tool stop due to the tension of the shoelace. Regarding the fixation of the binding tool stop part of this example to the outer upper part, the position is set so as to secure the distance and direction from the starting and ending shoelace-throughs 25. As for the fixing method, general methods such as adhesives or edge stitching are used. As for the installation on the outer side of the upper part, it is intended to prevent the binding tool from falling off from the binding-tool stop due to the contact between the shoes of both feet when the binding tool is installed on the inner side.

FIG. 3 shows the location of the binding-tool stop 6 in the upper part 12. FIG. 3(1) shows the positional relationship of the shoelace-throughs 2, the shoelace 3, the binding tool 4 and the binding-tool stop 6 when the open part is open for putting on and taking off shoes.

FIG. 3(2) shows the state in which tension is applied to both ends of the shoelace by means of the binding tool through the starting and ending shoelace-throughs 25 and the state in which the binding tool is rotated as the fulcrum with the starting and ending shoelace-throughs while maintaining tension. And then the binding tool is locked to the binding-tool stop. As shown in FIG. 3(1), the total length of the shoelace-through section from $L_1$ to $L_8$ is the required effective shoelace length 35, and there is a difference in the length from the starting shoelace-through 26 and the ending shoelace-through 27 to each end of the shoelace in the binding tool. This is due to the fact that the excess shoelace length that is pulled out of each shoelace-through is different with respect to the tightening shoelace length 36. In this example, the excess of $L_1$ to $L_4$ is assumed to be drawn from the starting shoelace-through, and the excess of $L_8$ to $L_5$ is assumed to be drawn from the ending shoelace-through. FIG. 3(2) shows the direction of the tension applied to the shoelace from both ends of the shoelace through the starting and ending shoelace-throughs. The direction of the tension from the starting and ending shoelace-throughs is a direction of the bisector of the included angle between the two starting and ending shoelace-throughs sections. The purpose is to efficiently apply tension from the starting and ending shoelace-throughs. In this example, with respect to the second step of claim 6 of "a component force on the plane containing the lines of the two starting and ending lacing sections (the plane formed by the lines of action of the two tensions) of the diagonally upward direction of the combined force of tensions being directed toward an intersection of extension lines of the starting and ending shoelace-throughs sections", it produces the least drag on the starting and ending shoelace-throughs by pulling the binding tool toward the direction of the bisector of the included angle between the two starting and ending shoelace-throughs sections. The location of the binding-tool stop is determined by considering the direction of the bisector mentioned above and the excess length related to the tightened shoelace length and the required effective shoelace length, etc.

The binding tool maintains the tension of the shoelace and secures the tightness with the shoelace by attaching to the binding-tool stop fixed to the upper, but also the tension from both ends of the shoelace is close to equal to the tensile force acting on the two starting and ending shoelace-throughs.

FIG. 4 provides an explanation of the placement of the starting and ending shoelace-throughs 25 in this example. FIG. 4 shows the upper part 12 as a solid line, the sole as a broken line, and the areas of high foot pressure on the forefoot sole due to foot movement as oval-shaped two-dot chain lines. This is near the both ends of the transverse arches described above. Generally, lace shoes are tightened by shoelaces from near the base of the toes (the joint between the base bone and metatarsal bone pertaining to the toes) to near the top of the instep. The tying of shoelaces near the top of the instep is essential to eliminate concerns about shoes coming off. This position is located in the upper of the arch of the foot (near the top of the inner arch described above) and is the part of the foot where there is little change in circumference of the foot due to exercise. The base of the toes is another position that is subject to relatively little change in circumference positioned as foot circumference. On the other hand, as shown in FIG. 4, foot pressure on the sole is greater at the front of the inner and outer arch, which is also the most significant location with respect to changes in foot circumference due to human movement.

For lace shoes as shown in FIG. 4, the circumference change is large near the center of the upper and lower stage of the shoelace-throughs. At locations where there is a large change in circumference, the change in shoelace tension of the shoelace-through section is also large. If the magnitude of tension in each shoelace-through section is uneven, large tension changes of that shoelace-through section contribute to the rapid equalization of the overall tension of the shoelace through adjacent the shoelace-through section. In other words, the tension in the starting and ending shoelace-through sections 31 are higher than in the other sections when the laces are tightened, but.in order to equalize the tension of the entire shoelace, it is desirable to place the starting and ending shoelace-through sections at the location in largest circumferential length change Therefore, the second and third stages in the inner row having five stages are selected as the starting and ending shoelace-throughs.

In claim 1, "neither on both end stages" with respect to the starting and ending shoelace-throughs is intended for the above effect. In addition, the second stage of the inner row as the starting shoelace-through has a large excess shoelace length from the required effective shoelace length to the tightening shoelace length as mentioned above, which has the effect of quick shoelace pullout.

The lace shoe 1 in the present invention is arranged one more shoelace-through in any of the inner or outer blade parts for one shoelace 3 that passes through all the shoelace-throughs 2 in a group arranged in the mutually facing blade parts 13. As a result, the both ends of the shoelace appear on either the inner or outer side and are tied to the binding tool 4, thus tightening the lacing shoe. There are 144 ways how to tie a shoelace with the starting and ending shoelace-throughs 25 as the second and third stages of the inner row in this example. FIG. 5(1) through 5(10) show the results of the study on the shortest path in light of the conditions of this example. The four shoelace-throughs located on the left blade part are numbered from 1 to 4, starting from the top. The five shoelace-throughs located on the right blade part are numbered from 1 to 5 from the top stage. This figure shows the path of a shoelace by means of a schematic diagram of the arrangement of shoelace-through sections, where the distance between the inner and outer rows is 3, with the inner and outer rows as straight lines. And the height of the upper and lower stages of the inner and outer rows are matched, so the distance between the stages on the right row is 1, and the distance between the stages on the left row is 1.33. The numerical values listed in FIG. 5(1) through 5(10) indicate the path length assuming the shoelace path is a straight line with the shoelace-through as the change point, and these shoelace tying methods are from the minimum path length to the 10th place for the 144 arrangements described above.

The arrangement of the shoelace path shown in FIG. 5(1) is the minimum path length. For this arrangement, it is the minimum path length even with the addition of the change in row spacing and the spread in the row direction from the lowest stage (the spread in the row direction of the required effective shoelace length state as shown in FIG. 11). The method of tightening shoelaces in this example follows this result.

FIG. 6 illustrates the tension in the starting and ending shoelace-through sections 31 ($L_1$ and $L_8$ in FIG. 6(1)) in the present invention.

FIG. 6(1) through 6(3) show excerpts of the tongue part 14, shoelace-throughs 2, shoelace 3, binding tool 4, and the binding tool stop 6 in FIG. 1, showing changes in the operating conditions during tightening. FIG. 6(1) shows tension being applied to both ends of a shoelace through the starting and ending shoelace-throughs. FIG. 6(2) shows the state in which the binding tool is rotated approximately 90 degrees around the starting and ending shoelace-throughs while maintaining the tension in the starting and ending shoelace-through sections. FIG. 6(3) shows the state in which the binding tool is about to be further rotated by about 90 degrees to attach the binding tool to the binding-tool stop. FIG. 6(4) schematically shows these changes in the above state from the direction of the axis of rotation. In FIG. 6(1), by applying tension of the shoelace while moving the tip of the shoelace-band 22 upward as shown in FIG. 6(4), tension can be applied without contacting the tongue parts and the blade parts, and no significant vertical drag force acts on the starting and ending shoelace-throughs. Therefore, there is very little loss of tension due to friction at the starting and ending shoelace-through sections shown in [0022]. Of the second step in claim 6, "pulling the binding tool facing diagonally upward, a combined force of tensions being acted on the both ends of the single shoelace facing diagonally upward in order to shorten a contact length to the tongue part or the both blade parts," is intended for the above matters. By this method, if the effect of the tension from both ends of the shoelace applied to the starting and ending shoelace-through sections ($L_1$ and $L_8$) extends to three sections as shown in [0022], the area subject to friction would be the shoelace-through sections of $L_2$, $L_3$ and $L_4$ from the starting shoelace-through 26 and the shoelace-through sections of $L_7$, $L_6$ and $L_5$ from the ending shoelace-through 27. Therefore, the tension from the end of the shoelace is applied to all shoelace-through sections. In the usual method of tightening lace shoes, as shown by the broken line in FIG. 6(4), there is contact at the tongue part of the starting and ending shoelace-through sections, which is folded back and tied, so that in the starting and ending shoelace-through sections, as in other sections ($L_2$ to $L_7$), a decrease in tension due to friction of the shoelace-through and tongue part, etc., is inevitable. As explained above, the tension at the starting and ending shoelace-through sections in FIG. 6(1) is maintained in FIG. 6(2), where the binding tool is rotated approximately 90 degrees with the starting and ending shoelace-throughs as a fulcrum. Furthermore, as shown in FIG. 6(3), tightening is ended by being attached by the binding tool to the binding-tool stop with aforementioned tension maintained. The tension required for the above is done entirely by manipulation of the lace picking part 52 at the rear of the binding tool. The shoelace can be easily rotated in the direction that the binding tool contact the binding-tool stop while adjusting the strength by the moderate pressure applied to the foot by the tightening of the shoelace. With respect to the action of diagonal upward tension in the starting and ending shoelace-through sections shown in FIG. 6(1) through (4) above, there is no difference from the operation in the shoelace-band described above, even in normal shoelace-throughs, as long as the force from the two ends of the shoelace can lift the blade part.

As an example, a group of shoelace-throughs with nine shoelace-throughs 2 is shown. However, if the number of shoelace-throughs is odd, it can be increased by reducing the friction between the shoelace 3 and the tongue section 14 or the shoelace-throughs. Conversely, for materials with high friction, the total number of the shoelace-throughs in a group must be reduced. The structure and shape of the binding tool 4 and the binding-tool stop 6 in this example are not limited to Example 1, as long as both ends of the shoelace can be bound in the same direction and then fastened. However, it is desirable to easily change the tying position of both ends of the shoelace in order to be able to tighten the lace according to the circumference of each part of a foot. Also, the locking structure with the binding tool and the binding-tool stop is not limited to this example. A buckle fixed on an upper part as a binding tool stop and a fitting part that engages with the buckle as a binding tool can be placed. Similarly, male and female hook and loop fasteners are also assumed for locking.

Example 2

Regarding FIG. 7, FIG. 7(1) shows an example of a group of shoelace-throughs (shoelace bands 22) 2 with 4 stages at an inner blade part and 3 stages at an outer. FIG. 8 shows a schematic diagram of the path lengths related to the placement of the shoelace-throughs. FIG. 8(1) shows the shortest path among 12 ways of tying shoelaces with inner 4 stages and outer 3 stages, with the starting and ending shoelace-throughs 25 in the second and third stages of the inner row, and the path lengths are indicated below the drawing number. For reference, the shortest path and path length for the case of inner 5 stages and outer 4 stages in FIG. 5(1) are re-posted in FIG. 8(3). FIG. 8(1) shows the same conditions as in FIG. 5, i.e., the same spacing between inner and outer rows and the same length from the top stage to the bottom stage, with the stages of each row equally spaced, with a group of shoelace-throughs on the inner and outer sides. Comparing the inner 4 stages and inner 5 stages lace shoes, the difference in path length of about 6, which is about twice as long as the row spacing of 3, is due to two more shoelace-through sections. The path length should be the shortest path when the same number of shoelace-throughs are arranged, but there are advantages and disadvantages with respect to reducing the number of shoelace-throughs and shortening the path length. The advantage is that tension from both ends of the shoelace can easily be applied to the entire shoelace, and the moderate tension facilitates tightening. On the other hand, the overall shoelace length is shortened, resulting in a loss of fit due to the elasticity of the entire shoelace. At the same time, delicate tightening for each part of the foot is not possible with respect to changes in circumference of each part of the foot.

Furthermore, while the advantage of a short shoelace shoe is that it can be easily tightened by moderate tension, it is difficult to set the appropriate tension according to the changes in each part of the foot during exercise. The reason for this is that the entire shoelace is shortened, thus shortening the range of change due to elasticity. Essentially, this is because a proper fit can be obtained by fitting within the elastic deformation of the shoelace and the upper part of the shoe. Therefore, FIG. 7(2) shows an example with a length-adjusting buckle 53 at the top of the instep. Loose tensioning can be done with the binding tool 4 and binding-tool stop 6 for tightening, and fine adjustment can be done with the buckle for a shoelace length adjustment 53 at the top of the instep. In addition, the use of a shoehorn or similar device may allow shoes to be put on and taken off using only the buckle for a shoelace length adjustment. Specific examples regarding the structure of the buckle for a shoelace length adjustment are shown in FIGS. 7(3) and 7(4). The buckle button 54, which is a projection in the center of the buckle, can be pushed in, which loosens the internal shoelace fastener, and the shoelace can be pulled out of the buckle by the lace picking part 52 for length adjustment. The buckle button is equipped with a compression coil spring 56 at the inside end, which returns to its original shape by removing the pushing force, and the locking part of buckle 55 inside functions.

Example 3

In Example 1, the procedure for easily tightening the lace shoe by one-handed operation of the lace picking part 52 of the shoelace 3 tied to the binding tool 4 is shown. The tension through the starting and ending shoelace-throughs 25 is first predominantly a tensile force to the blade part 13 of the outer side 18, and then folds back to the blade part of the inner side 17 from the rotation with the starting and ending shoelace-throughs as the fulcrum, adding tensile force. A visual element was added to further facilitate the operation of balancing the tension in this operation: the lace shoe shown in FIG. 9. FIG. 9 shows the lace shoe of Example 1, with the eyelets 21 as the shoelace-throughs 2 and the tongue part 14 marked with the inner and outer center line 15 shown in an understandable pattern. The addition of visual assistance to the tightening operation, which is performed by grasping the distance between the inner or outer blade part and the center line of the tongue part, further facilitates equal tensioning of the inner and outer blade part.

As mentioned above, for the present invention, the path distance between the starting and ending shoelace-throughs must be minimized for efficient tightening of the lace shoe. It is also noted above that excluding the two ends of the row as the arrangement of the starting and ending shoelace-throughs is effective in equalizing the tension of the shoelace 3. FIG. 8(1) shows the arrangement of the shoelace-through sections that is the shortest path among the 12 paths with the second and third stages of the right row as the starting and ending shoelace-throughs. And this arrangement of the shoelace-through sections satisfies the above conditions, in the lace shoe of the shoelace-throughs of the outer 3 and inner 4 stages in FIG. 7. FIG. 8(2) shows an example of the arrangement of shoelace-through sections using the conventional method of tightening. Compared to the conventional type, FIG. 8(1) results in one less shoelace-through and a 13% reduction in path length. FIGS. 8(3) and 8(4) show the arrangement of 4 stages of shoelace-throughs on the left side and five stages on the right side that satisfy the above conditions. FIG. 8(5) shows the path of shoelace in a conventional shoelace-through sections with five shoelace-throughs on both sides. FIGS. 8(3) and 8(4) result in one less shoelace-through and a 10% reduction in path length. Comparing FIGS. 8(1) and 8(2), and comparing FIG. 8(3) or 8(4) and 8(5), there is no difference in the number of shoelace-throughs on the right side, as described above. Although the number of shoelace-throughs on the left side has been reduced, there is, in effect, one more tightening point on the left side, as shown in FIG. 6(3), due to the attachment of both ends of the shoelace of the binding tool 4 to the binding-tool stop 6. This indicates that the shoelace tightening method according to the present invention is an efficient tightening method that reduces the overall shoelace-through section distance without reducing the number of tightening sections, and the number of shoelace-throughs is reduced by one compared to the normal tightening method.

Example 4

FIG. 10 shows the invention used in a so-called boot that covers from the toe through the ankle to the shin. If, as in the present case, the planes in which tension is applied to the shoelace are very different, such as when the shoelace is tightened on the instep and above the ankle, it is difficult to tighten a lacing shoe with a single shoelace. This is because the loss of tension due to friction is greater when tension is applied only from the both ends of a single shoelace. "A group of shoelace-throughs" that can be tightened with a single shoelace as described in claim 1 refers to a plurality of shoelace-throughs that can be tightened by tension from both ends of a single shoelace, and the example in this FIG. 10 is a case where there are two groups of shoelace-throughs for the left or right half foot.

The invention claimed is:

1. A lace shoe that can be tightened according to the circumference of each part of a foot, regarding the right or left half foot of the lace shoe, the lace shoe comprising:

both blade parts of shoelace-stay installed on an inner and an outer side of an upper part of the lace shoe, the inner side and the outer side being defined in terms of directions of a part of a shoe, wherein the inner side corresponds to a big toe side and the outer side corresponds to a little toe side of the foot when worn in a shoe;

a group of shoelace-throughs arranged on the both blade parts with one greater number of shoelace-throughs in one blade part than the other blade part, the shoelace-throughs forming a single row on each blade part, the single row of shoelace-throughs on each blade part having the same length between either end stage of the row, such that the one greater number of shoelace-throughs does not extend beyond an end stages of either row;

a single shoelace that alternately tightens the inner side and the outer side, passes through all of the group of shoelace-throughs, and can be closed by tying both ends of the shoelace;

starting and ending shoelace-throughs that are starting and ending points of the single shoelace in the group of shoelace-throughs, the starting and ending shoelace-throughs being two adjacent points that are both at a location other than either of the end stages of the row, the end stages being aligned in a transverse direction to the row, the starting and ending shoelace-throughs being placed on the one blade part, having the shortest path among all the paths of the single shoelace between the starting and ending points;

a binding tool positioned in alignment with the two adjacent points in the transverse direction, the binding tool being that with which is tied both ends of the single shoelace in the same direction, allowing the single shoelace to be pulled from the shoelace-throughs continuous to the starting and ending shoelace-throughs in directions of sections between two continuous shoelace-throughs, further allowing the single shoelace to be pulled facing diagonally upward, wherein the sections constitute starting and ending shoelace-throughs sections; and a binding-tool stop that is fixed to the upper part on the side of the other blade part where the starting and ending shoelace-throughs are not placed, locking the binding tool.

2. The lace shoe of claim 1, wherein the one blade part is located on the inner side of the upper part.

3. The lace shoe of claim 1, wherein either the binding tool or the binding-tool stop comprise a magnet and the other comprise a magnet or magnetic material for locking the binding tool to the binding-tool stop.

4. The lace shoe of claim 1, further comprising a buckle for a shoelace length adjustment with the single shoelace in an uppermost shoelace-throughs section.

5. The lace shoe of claim 1, further comprising:

a tongue part between the instep and the both blade parts or the single shoelace in order to protect the foot; and visible marks symmetrical from a center line of the inner and outer sides in the tongue part, being able to see rows of the shoelace-throughs or edges of the both blade parts on the visible marks.

6. A method of tightening the lace shoe according to claim 1, comprising:

a first step of passing or hooking all of the group of shoelace-throughs with the starting and ending shoelace-throughs as the starting and ending points in an open state where the lace shoe can be put into;

as a second step, while being put on with the lace shoe in the first step, the step of pulling the binding tool facing diagonally upward, a combined force of tensions being acted on the both ends of the single shoelace facing diagonally upward in order to shorten a contact length to the tongue part or the both blade parts, and a component force on the plane that is formed by lines of action of the two tensions and containing the lines of the two starting and ending lacing sections of the diagonally upward direction of the combined force of tensions being directed toward an intersection of extension lines of the starting and ending shoelace-throughs sections;

a third step of rotating the binding tool around the starting and ending shoelace-throughs, while maintaining degrees of the tensions acted on the starting and ending shoelace-throughs sections in a state of the second step; and a fourth step of locking the binding tool to the binding-tool stop after the third step.

* * * * *